US008956438B2

(12) United States Patent
Fang et al.

(10) Patent No.: US 8,956,438 B2
(45) **Date of Patent: *Feb. 17, 2015**

(54) LOW COEFFICIENT OF THERMAL EXPANSION CERMET COMPOSITIONS

(71) Applicant: Smith International, Inc., Houston, TX (US)

(72) Inventors: Zhigang Fang, The Woodlands, TX (US); Anthony Griffo, The Woodlands, TX (US); Gregory T. Lockwood, Houston, TX (US); Dah-Ben Liang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/693,981

(22) Filed: Dec. 4, 2012

(65) Prior Publication Data

US 2013/0092449 A1 Apr. 18, 2013

Related U.S. Application Data

(63) Continuation of application No. 09/494,877, filed on Jan. 31, 2000, now Pat. No. 8,323,372.

(51) Int. Cl.

| | |
|---|---|
| ***E21B 10/52*** | (2006.01) |
| ***E21B 10/46*** | (2006.01) |
| ***B22F 3/15*** | (2006.01) |
| ***C22C 29/00*** | (2006.01) |
| ***C22C 29/06*** | (2006.01) |

(52) U.S. Cl.

CPC ..... *E21B 10/46* (2013.01); *B22F 3/156* (2013.01); *C22C 29/00* (2013.01); *C22C 29/06* (2013.01); *E21B 10/52* (2013.01); *B22F 2998/00* (2013.01)

USPC ..... 75/242; 175/374

(58) Field of Classification Search

CPC ..... E21B 10/46; E21B 10/52

USPC ..... 75/175; 175/374, 425

See application file for complete search history.

(56) References Cited

U.S. PATENT DOCUMENTS

| | | | |
|---|---|---|---|
| 3,816,081 | A | 6/1974 | Hale |
| 4,101,318 | A | 7/1978 | Rudy |

(Continued)

FOREIGN PATENT DOCUMENTS

| | | | |
|---|---|---|---|
| EP | 0085125 | A1 | 8/1983 |
| GB | 1450654 | A | 9/1976 |

(Continued)

OTHER PUBLICATIONS

Final Office Action in U.S. Appl. No. 09/494,877 dated Dec. 2, 2011, total 10 pages.

(Continued)

*Primary Examiner* — Jie Yang

(74) *Attorney, Agent, or Firm* — Snell & Wilmer L.L.P.

(57) ABSTRACT

A cutting element for engaging earthern formations having a wear surface formed from a low coefficient of thermal expansion (CTE) composition including a polycrystalline diamond or polycrystalline cubic boron nitride hard phase material and a ductile phase low CTE material formed from an alloy made of Co, Ni, Fe, C, and Mn. The hard phase material is bonded to one another by the ductile phase material to form the low CTE composition.

13 Claims, 6 Drawing Sheets

(56) References Cited

U.S. PATENT DOCUMENTS

| | | | | |
|---|---|---|---|---|
| 4,531,595 | A | 7/1985 | Housman | |
| 4,556,424 | A | 12/1985 | Viswanadham | |
| 4,694,918 | A * | 9/1987 | Hall | 175/430 |
| 4,696,696 | A | 9/1987 | Fujita et al. | |
| 4,840,665 | A | 6/1989 | Fujii | |
| 5,290,507 | A | 3/1994 | Runkle | |
| 5,880,382 | A | 3/1999 | Fang et al. | |
| 5,934,542 | A | 8/1999 | Nakamura et al. | |
| 5,992,546 | A | 11/1999 | Heinrich et al. | |
| 6,063,502 | A | 5/2000 | Sue et al. | |
| 6,197,084 | B1 | 3/2001 | Liang | |
| 2006/0222853 | A1 | 10/2006 | Sue et al. | |

FOREIGN PATENT DOCUMENTS

| | | | |
|---|---|---|---|
| GB | 2273301 | A | 6/1994 |
| JP | 53052212 | | 5/1978 |
| JP | 63203705 | | 8/1988 |
| JP | 02277746 | | 11/1990 |
| JP | 7118775 | | 5/1995 |
| JP | 10284547 | | 10/1998 |
| JP | 05156301 | B2 | 3/2013 |
| RU | 2062813 | C1 | 6/1996 |

OTHER PUBLICATIONS

Non-Final Office Action in U.S. Appl. No. 09/494,877 dated May 10, 2011, total 20 pages.
Non-Final Office Action in U.S. Appl. No. 09/494,877 dated Sep. 10, 2010, total 7 pages.
Non-Final Office Action in U.S. Appl. No. 09/494,877 dated Mar. 22, 2010, total 13 pages.
Final Office Action in U.S. Appl. No. 09/494,877 dated Aug. 21, 2009, total 12 pages.
Non-Final Office Action in U.S. Appl. No. 09/494,877 dated Jan. 9, 2009, total 14 pages.
Final Office Action in U.S. Appl. No. 09/494,877 dated May 14, 2008, total 29 pages.
Non-Final Office Action in U.S. Appl. No. 09/494,877 dated Oct. 1, 2007, total 22 pages.
Final Office Action in U.S. Appl. No. 09/494,877 dated Apr. 2, 2007, total 12 pages.
AMETEK, Tech Briefs, Sealvar (F-15 alloy) Nickel Iron Cobal Strip http://www.ametekmetals.com/metalstripPDF/130066.pdf,Feb. 1998.
Non-Final Office Action in U.S. Appl. No. 09/494,877 dated Oct. 24, 2006, total 20 pages.
Final Office Action in U.S. Appl. No. 09/494,877 dated Mar. 31, 2006, total 8 pages.
Non-Final Office Action in U.S. Appl. No. 09/494,877 dated Oct. 13, 2005, total 9 pages.
Final Office Action in U.S. Appl. No. 09/494,877 dated Jun. 15, 2005, total 7 pages.
Final Office Action in U.S. Appl. No. 09/494,877 dated Dec. 29, 2004, total 8 pages.
Non-Final Office Action in U.S. Appl. No. 09/494,877 dated Jul. 14, 2004, total 10 pages.
Non-Final Office Action in U.S. Appl. No. 09/494,877 dated Dec. 1, 2003, total 5 pages.
Non-Final Office Action in U.S. Appl. No. 09/494,877 dated May 1, 2003, total 5 pages.
Final Office Action in U.S. Appl. No. 09/494,877 dated Jan. 2, 2003, total 5 pages.
Final Office Action in U.S. Appl. No. 09/494,877 dated Dec. 26, 2001, total 5 pages.
Non-Final Office Action in U.S. Appl. No. 09/484,877 dated Apr. 16, 2001, total 4 pages.
Non-Final Office Action in U.S. Appl. No. 09/494,877 dated Apr. 23, 2002, total 4 pages.
Machine translation of JP 05156301, published Jun. 1993.

* cited by examiner

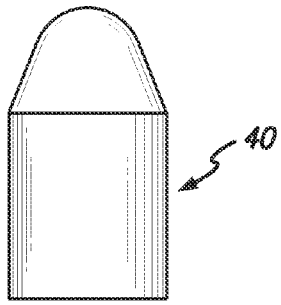
FIG. 7
FIG. 8
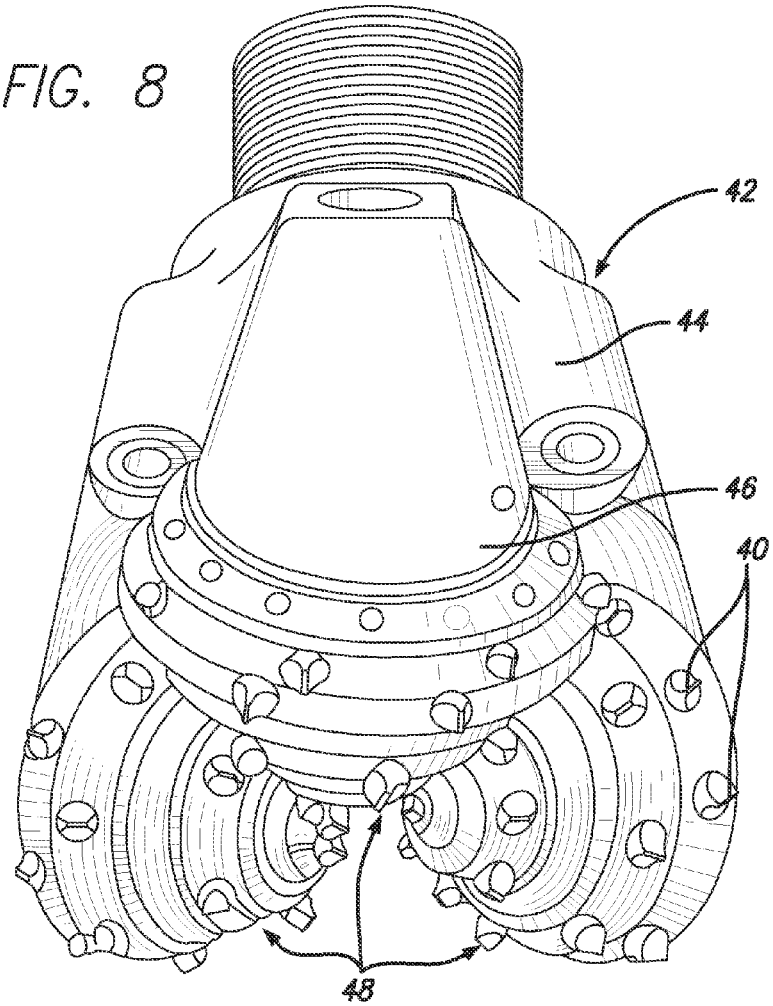

LOW COEFFICIENT OF THERMAL EXPANSION CERMET COMPOSITIONS

CROSS-REFERENCE TO RELATED APPLICATIONS

This patent application is a continuation of and claims priority pursuant to 35 U.S.C. §120 to U.S. application Ser. No. 09/494,877, filed Jan. 31, 2000, now U.S. Pat. No. 8,323,372 issued Dec. 4, 2012, which is specifically incorporated herein in its entirety by reference.

FIELD OF THE INVENTION

This invention relates to cermet compositions and methods of making the same and, more particularly, this invention relates to low coefficient of thermal expansion cermet compositions comprising a binder alloy that is specifically engineered to provide improved thermal shock resistance when compared to conventional cemented tungsten carbide (WC—Co).

BACKGROUND OF THE INVENTION

Cermet compositions, such as cemented tungsten carbide (WC—Co), are well known for their mechanical properties of hardness, toughness and wear resistance, making them a popular material of choice for use in such industrial applications as mining and drilling where its mechanical properties are highly desired. Because of its desired properties, WC—Co in, particular has been the dominant material used as hard facing, wear inserts, and cutting inserts in rotary cone rock bits. The mechanical properties associated with WC—Co and other cermets, especially the unique combination of hardness toughness and wear resistance, make these materials more desirable than either metals or ceramics alone.

Although WC—Co is known to have desired properties of hardness, toughness and wear resistance, it is also known to suffer from thermal shock-related fatigue cracking in many applications. For example, WC—Co compacts that are used as cutting elements for drill bits often develop a cris-cross pattern of cracks in wear flat surfaces or "wear flats". The pattern of cracks formed on these wear flats is known as "heat checking" and is caused from exposing the wear surface to cyclic abrasive friction heat and drilling fluid cooling during the drilling operation, e.g., when the drilling assembly is rotated. Such heat checking is known to be the cause of thermal shock or thermal fatigue related crack formation, crack propagation, and ultimately catastrophic failure.

The problem of heat checking is attributed to the relatively poor thermal properties of the cobalt (the binder material) when compared to that of the tungsten carbide. Prior attempts to correct this problem, to increase the heat checking resistance of WC—Co, has been to reduce the cobalt binder content and balance other mechanical properties of the composition through grain size adjustment. However, reducing the cobalt binder content adversely impacts other properties of the resulting cemented tungsten carbide material. Generally speaking, as you decrease the cobalt binder content you also reduce the fracture toughness, and increase the hardness, of the cemented tungsten carbide, thereby making the composition brittle and more susceptible to fracture and failure. As you increase hardness you also increase wear resistance, but this is all at the expense of fracture toughness.

Fracture toughness is a limiting factor in demanding industrial applications such as high penetration drilling, where WC—Co inserts often exhibit gross brittle fracture that leads to catastrophic failure. Thus, prior attempts at addressing unwanted heat checking, to reduce or control thermal shock related catastrophic failure, has been at the expense of reduced fracture toughness, which also is known to cause catastrophic failure.

It is, therefore, desirable that a cermet composition be developed that has improved thermal shock resistance when compared to conventional cemented tungsten carbide materials. It is desirable that such cermet composition display improved thermal shock resistance without sacrificing such properties as fracture toughness and wear resistance when compared to conventional cemented tungsten carbide materials. It is desired that cermet compositions of this invention be adapted for use in such applications as rock bits, hammer bits, mining and drill bits, and other applications such as mining and construction tools where improved thermal shock resistance is desired.

SUMMARY OF THE INVENTION

Low coefficient of thermal expansion (CTE) thermal expansion Cermet composition of this invention generally comprise a hard phase material and a ductile phase binder alloy, wherein the binder alloy is specially designed having a CTE that is closely matched to the CTE of the hard phase material. Hard phase materials used to form low CTE compositions of this invention include cermets having a hard grain component selected from the group of carbides, nitrides, carbonitrides, and borides formed from refractory metals such as W, Ti, Mo, Nb, V, Si, Hf, Ta, and Cr. The ductile phase binder alloy is formed from a mixture of metals selected from the group consisting of Co, Ni, Fe, W, Mo, Ti, Ta, V, Nb, C, B, Cr, and Mn.

In a preferred embodiment, low CTE compositions of this invention comprise WC as the hard phase material, and a binder alloy formed from a mixture of Fe, Co, and Ni, and is generally referred to as WC-M, where M refers to the binder alloy material. Ductile phase binder alloys of this invention have a CTE of less than about 10 ppm/° C. within a temperature range of from 100 to 700° C., to produce cermet compositions having a CTE that is less than that of a conventional WC—Co composition comprising an equal amount of metal binder.

Low CTE cermet compositions of this invention, comprising a binder alloy having thermal expansion characteristics closely matched to the hard phase material, provide improved resistance to thermal shock and thermal fatigue related failure, thereby enhancing the service life of products formed therefrom.

BRIEF DESCRIPTION OF THE DRAWINGS

These and other features and advantages of the present invention will become appreciated as the same becomes better understood with reference to the specification, claims and drawings wherein:

FIG. 7 is a schematic perspective side view of a drill bit insert formed from a low CTE cemented tungsten carbide composition of this invention; and FIG. 8 is a perspective side view of a rotary cone rock bit comprising the insert of FIG. 7.

DETAILED DESCRIPTION OF THE INVENTION

Conventional cemented tungsten carbide (WC—Co) is a composition comprising tungsten carbide (WC) grains and a ductile metallic binder such as cobalt (Co). Compacts formed from WC—Co are known to develop heat checking from exposure to cyclic friction-generated heat and cooling from drilling fluid. The heat checking gradually develops into cracks which ultimately propagate and cause the cemented tungsten carbide part to catastrophically fail. Cermet compositions; namely, cemented tungsten carbide compositions, of this invention (WC-M) are different from conventional cemented carbide compositions in that they do not use a single or pure binder material, e.g., cobalt. Rather, cermet compositions of this invention comprise a low coefficient of thermal expansion (CTE) binder alloy (M) that is formed from a blend of materials specifically designed to have properties of thermal expansion similar to or matching that of the tungsten carbide (WC) grains, thereby providing improved thermal shock resistance, reduced heat checking and thermal shock related material failure.

Figure 1:
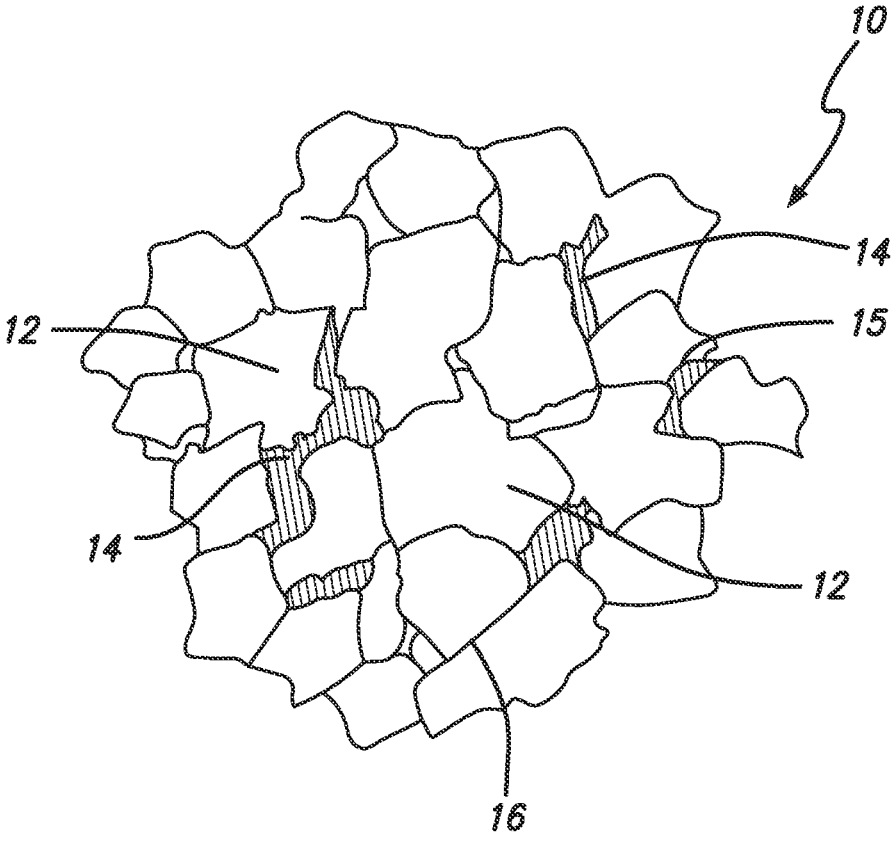
FIG. 1 is a schematic photomicrograph of a portion of a first embodiment low CTE cermet composition prepared according to principles of this invention.

FIG. 1 illustrates a microstructure of a cemented tungsten carbide composition (WC-M) 10, prepared according to principals of this invention, comprising a hard phase made up of grains (e.g., WC) 12 that are bonded to one another by a binder alloy phase (M) 14. The binder alloy phase is formed from a mixture of materials that are specifically selected to match, as closely as possible, the thermal expansion characteristics of the tungsten carbide grains without sacrificing other desired properties of the composition, such as fracture toughness, hardness, and wear resistance.

Prior approaches taken to improve the thermal shock resistance of conventional cemented tungsten carbide (WC—Co) have followed two paths each based on the general relationship for monolithic materials, that R::K/β, where R=resistance to thermal shock, K=coefficient of thermal conductivity, and β=coefficient of thermal expansion. Because the WC grains have a different thermal conductivity than that of the cobalt binder (the WC grains have a higher thermal conductivity), a first path of reducing the thermal shock resistance difference between these materials was to reduce the amount of cobalt binder that was used to form the composition. Unfortunately, reducing the amount of the cobalt binder, while having some effect on reducing the resistance to thermal shock of the composition, also reduced the composition's fracture toughness, making the resulting composition unsuited for use in rock bits and other similar drill bit applications.

Another approach used to improve the composition's resistance to thermal shock was to increase the WC grain size, thereby theoretically minimizing the magnitude of the fracture or stress zones between the WC grains and the cobalt binder. While the use of larger sized grains of WC was observed to increase the thermal conductivity of the WC—Co composition, which was beneficial to the overall thermal resistance of the composition, heat checking and thermal related failures of parts formed from the composition still occurred.

Rather than trying to improve the thermal shock resistance of the composition by past methods, i.e., by focusing on the thermal conductivity of the WC grains and binder material used to form the composition, this invention instead focuses on matching the CTE of both the binder phase and the hard phase of the composition to reduce the overall difference between the CTE of the materials within the composition itself. More specifically, this invention focuses on reducing the difference between, in a preferred embodiment, the CTE of the binder (M) and the CTE of the WC grains, and/or reducing the overall CTE of the so-formed WC-M composition. It has been discovered that improved properties of thermal shock resistance superior to that achieved through the conventional approach discussed above, are achieved by this approach.

WC has a CTE that is significantly less (approximately 5.2 ppm/° C.) than that of pure cobalt (approximately 12.5 ppm/° C.), presenting a mismatch in thermal expansion characteristics between the WC grains and Co used as the metal binder component to form a WC—Co composition. Rather than using pure cobalt as a single binder material, this invention instead focuses on the development and use of a binder alloy formed from more than one element that is specifically designed to have a CTE that is less than that of cobalt, and that more closely matches CTE of the WC grains. It is understood that the cobalt found in conventional WC—Co compositions includes a small amount of WC that was dissolved into it during the sintering process. This, however, is not the same as using a binder material that is intentionally formed from combining two or more different materials prior to sintering. The binder alloy of this invention provides a closely-matched CTE while not sacrificing other desired composition properties such as fracture toughness.

Hard phase grains used to form compositions of this invention can be made from different types of materials. Suitable materials for forming the hard phase grains are cermets that include hard grains formed from carbides, nitrides, carbonitrides or borides formed from refractory metals such as W, Ti, Mo, Nb, V, Si, Hf, Ta, and Cr. Example hard grain materials include WC, TiC, TaC, TiN, TiCN, $TiB_2$, and $Cr_2C_3$. Low CTE cemented tungsten carbide compositions of this invention are formed by using WC hard grain material.

The binder alloy (M) component of the composition is preferably formed from two or more metal materials that when combined have a CTE that is lower than that of pure cobalt alone. Thus, cemented tungsten carbide compositions (WC-M) comprising such binder alloy has an overall CTE less than that of conventional WC—Co having an equal metal binder content. The binder alloy can have a CTE that is less than or greater than that of the hard grain phase, with the objective being that the absolute difference between the CTE of the binder alloy and hard grain phase be minimized.

The binder alloy is formed from a mixture or blend of metal materials such as Co, Ni, Fe, W, Mo, Ti, Ta, V and Nb, which may be alloyed with each other or with C, B, Cr or Mn. Examples binder alloys of this invention can be formed by combining iron (Fe) with at least one other of the above-identified materials. Iron is useful as a binder alloy because it is wide availability and provides a relatively wide working window with other binder materials to achieve the desired CTE goal.

A preferred binder alloy is one formed from a mixture of Co (CTE=12.5), Ni (CTE=13.3) and Fe (CTE=12.1). The binder alloy mixture can comprise up to about 60 percent by weight Co, up to about 50 percent by weight Ni, and in the range of from about 30 to 80 percent by weight Fe. Using less than about 30 percent by weight Fe, for a Co—Ni—Fe binder alloy, is not desirable because such amount is less than an effective amount to reduce the CTE of the binder alloy below that of Co alone. Using more than about 80 percent by weight Fe is also not desired because such amount necessarily reduces the amounts of the other the binder materials, Co and Ni, and the desired contributions that these materials provide to the WC-M composition, e.g., fracture toughness provided by Co. A particularly preferred low CTE binder alloy of this invention comprises in the range of from about 10 to 30 percent Co, 10 to 40 percent by weight Ni, and the remainder Fe.

The use of Co is desired in a preferred embodiment because it provides the desirable property of fracture toughness to the so-formed WC-M composition. However, it is not desired that greater than about 60 percent by weight of the Co be used because such amount will adversely impact the ability to form a binder alloy having a relatively low CTE, i.e., a CTE that is closer to that of the WC grains than that of a binder formed from Co alone. The use of Ni is also desired in a preferred embodiment for its ability to reduce the CTE of iron, thus reduce the CTE for the binder alloy. Using greater than about 50 percent by weight Ni, for a Co—Ni—Fe binder alloy, is not desired because such amount will have the effect of increasing the CTE of the binder. It is generally desired that the amount of Ni used to form the binder alloy be less than about 50 percent by weight, and more preferably, less than about 40 percent by weight. The use of Ni and its effects in metal alloys to provide properties of low expansion in iron alloys is discussed in the "Metals Handbook", Ninth Ed, Volume 3, 1980, American Society for Metals, Metals Park, Ohio, pgs 792 to 798, which is incorporated herein by reference.

Preferred binder alloys of this invention can include, in addition to Fe (and in addition to or instead of Co and Ni), Mn, Cr, and C. In example embodiments, Mn, Cr and C are materials that can be used in addition to Ni, Co and Fe because of the effect that small amounts of these materials have in either reducing the CTE of the Fe binder alloy, or have in stabilizing the temperature window during which such binder alloy provides a reduced CTE. For example, the use of carbon in small quantities mildly reduces the CTE of the binder alloy and also helps to provide a controlled temperature window during which temperature the binder alloy CTE is reduced. In forming alloy binders of this invention up to about 10 percent by weight each of Mn and/or Cr can be used, and up to about 1 percent by weight C can be used, as use of these materials above their respective amounts will not provide the above-identified benefits.

Binder alloys of this invention can be referred to as being "based" on a particular material, e.g., an iron-based binder alloy, that is present in the binder alloy in the greatest weight percentage. Accordingly, depending on the particular binder alloy materials used and their respective proportions, binder alloys of this invention can be iron based, cobalt based, or nickel based.

Low CTE binder alloys of this invention have a CTE of less than 10 ppm/° C. at a temperature in the range of from about 100 to 700° C. Ideally, it is desired that low CTE binder alloys of this invention have a CTE that is approximately equal to that of WC, i.e., having a CTE of less than approximately 6 within a temperature range of from about 100 to 700° C. Such low CTE binder alloys are desirable because they closely match the CTE of WC, thereby act to form a WC-M composition having reduced thermal stress and related reduced potential for thermal-induced failure. A preferred low CTE binder alloy is one that has a CTE that has an absolute, difference of less than about 5 ppm/° C., and more preferably of less than about 2 ppm/° C. when compared to the CTE of WC at the same operating temperature.

In a preferred embodiment, WC-M compositions of this invention comprise in the range of from 5 to 30 percent by weight of the binder alloy. Using less than about 5 percent by weight of the binder alloy is generally not desired because such low amount may not be effective in providing desired binder properties of fracture toughness to the composition, thereby providing a composition that is relatively brittle and not suited for demanding industrial applications such as high-penetration drilling. Using greater than about 30 percent by weight of the binder alloy is generally not desired because such amount may not result in the production of a composition having desired properties of hardness and wear resistance, thereby also providing a composition that may not be well suited for applications such as high-penetration drilling. In a particularly preferred embodiment, WC-M compositions of this invention comprise in the range of from 10 to 30 percent by weight of the binder alloy based on the total weight of the composition.

FIG. 1 graphically illustrates the relationship of the CTE for a WC-M composition of this invention (y axis) versus the CTE for a binder alloy (M) for two different WC-M compositions. This figures illustrates how the CTE of the WC-M composition increases more quickly with increasing binder alloy CTE for a WC-M composition comprising approximately 20 volume percent binder alloy than one comprising approximately 10 volume percent binder alloy. This, therefore, illustrates relative impact that the binder alloy CTE has on the WC-M composition CTE depending on the volume percent of binder alloy used. Based on this relationship it is evident that it would be desirable to use less rather than more binder alloy of a given CTE. However, as discussed above, the amount of binder alloy that is used to form the WC-M composition depends on other factors as well, such as the need to provide binder properties other than CTE, e.g., fracture toughness, to the resulting composition.

Figure 2:
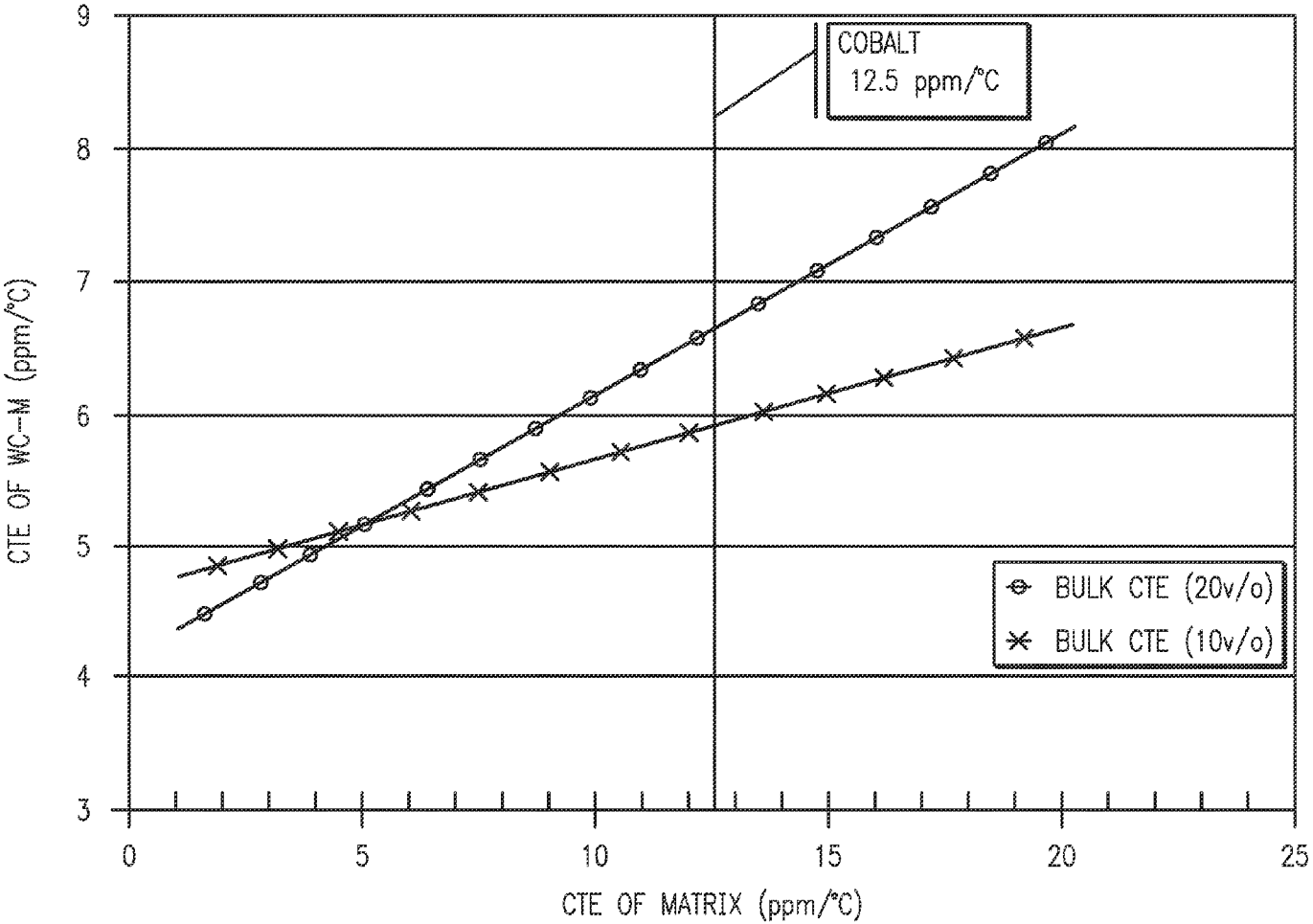
FIG. 2 is a graph illustrating a relationship between the CTE of low CTE cemented tungsten carbide compositions of this invention versus the CTE of alloy binders used with low CTE cemented tungsten carbide compositions having two different binder alloy volumes.
Figure 3:
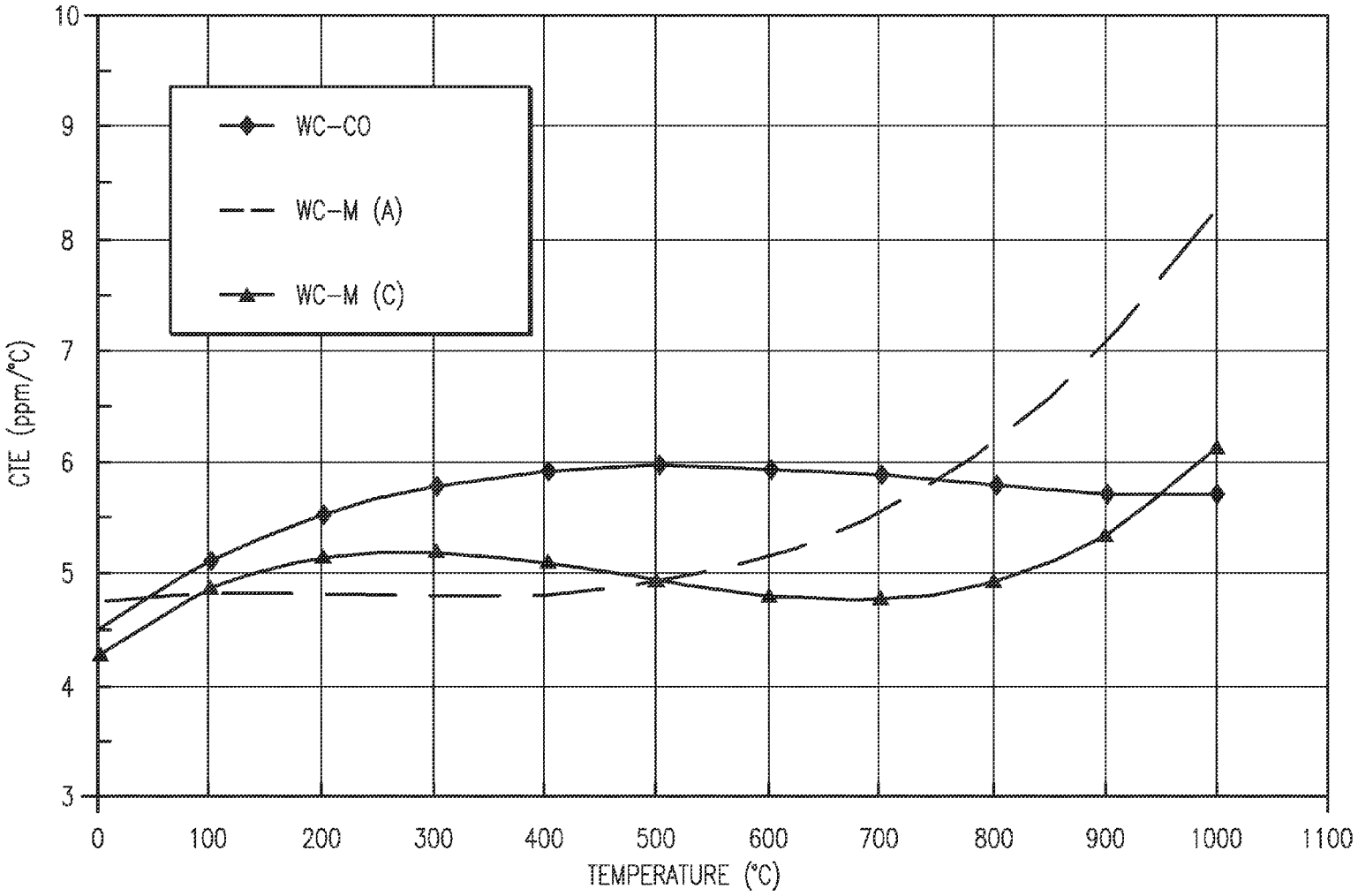
FIG. 3 is a graph illustrating the comparative CTE between a conventional WC—Co composition and two low CTE cemented tungsten carbide compositions of this invention as a function of temperature.

FIGS. 2 and 3 graphically illustrate relationship of CTE versus temperature for a conventional WC—Co composition as contrasted to two different WC-M compositions of this invention. These figures can best be understood with reference to the following example WC-M compositions.

Example No. 1

Low CTE WC-M Compositions A and B

First and second low CTE WC-M compositions were prepared according to principles of this invention by first preparing a binder alloy comprising approximately 47.6 percent by weight Fe, 29 percent by weight Ni, 19 percent by weight Co, 0.3 percent by weight Mn, and 0.3 percent by weight C, e.g., is an iron-based binder alloy. These materials were combined in a manner conventional to the practice of forming metal alloys. The binder alloy was provided in the form of metal powders prior to mixing with the WC having an average particle size in the range of from about 1 to 50 micrometers.

A first WC-M composition of this invention (A) was prepared using conventional cemented tungsten carbide forming techniques by combining WC grains having an average grain size in the range of from about 1 to 10 micrometers with the alloy binder described above provide a composition having a total binder alloy content of approximately 9.5 percent by weight. The WC grains and binder alloy were mixed together, pressed and sintered according to conventional methods known in the art.

A second WC-M composition of this invention (B) was prepared in a manner similar to that described above for the first WC-M composition, except that the amount of the binder alloy used to form the composition was increased to provide a composition having a total binder alloy content of approximately 13 percent by weight.

Example No. 2

Low CTE WC-M Compositions C and D

Third and Fourth WC-M compositions were prepared according to principles of this invention by first preparing a binder alloy comprising approximately 59.3 percent by weight Fe, 30 percent by weight Ni, 16 percent by weight Co, and 0.1 percent by weight C, e.g., another iron-based binder alloy. These materials were combined in a manner conventional to the practice of forming metal alloys. The binder alloy was in the form of metal powders before mixing with WC having an average particle size in the range of from about 1 to 50 micrometers.

A third WC-M composition of this invention (C) was prepared by combining WC grains having an average grain size in the range of from about 1 to 10 micrometers with the alloy binder described above provide a composition having a total binder alloy content of approximately 9.5 percent by weight. The WC grains and binder alloy were mixed together, pressed and sintered according to conventional methods known in the art.

A fourth WC-M composition of this invention (D) was prepared in a manner similar to that described above for the first WC-M composition, except that the amount of the binder alloy used to form the composition was increased to provide a composition having a total binder alloy content of approximately 13 percent by weight.

FIG. 3 graphically illustrates comparative CTEs for a conventional WC—Co composition v. WC-M composition (A) and WC-M composition (C) (of Examples 1 and 2, respectively) as a function of temperature, wherein each composition comprises approximately 9.5 percent by weight binder. For use in applications such as wear and cutting parts on drill bits, the temperature range of interest is between about 100° C. to 700° C. As illustrated, the conventional WC—Co composition has a CTE within the range of between 5 to 6 ppm/° C. within this temperature range. In contrast, WC-M composition (A) has a CTE that is less than 5 ppm/° C. under about 500° C., and that increases to about 5.5 at 700° C. WC-M composition (C) has a CTE that is less than 5.5 throughout this temperature range, and in fact is less than 5 above 500° C.

Both WC-M compositions (A) and (C) demonstrate a CTE value that is less than conventional WC—Co within the defined temperature window, and that is closely matched to the CTE value for WC itself (CTE for WC is approximately 5.2 ppm/° C.), thereby displaying improved properties of thermal shock resistance when compared to a conventional WC—Co composition.

Figure 4:
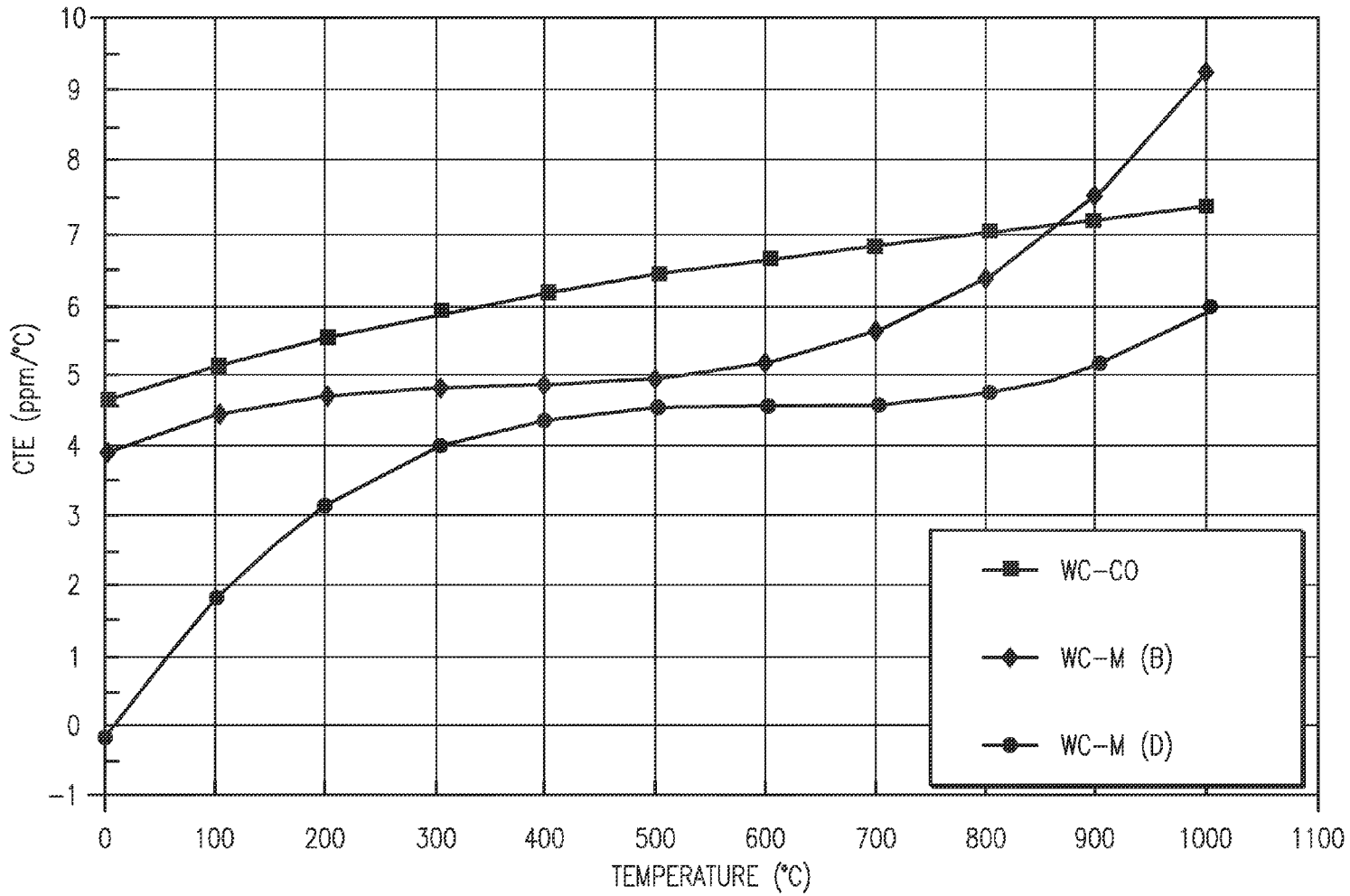
FIG. 4 is a graph illustrating the comparative CTE between a conventional WC—Co composition and two other low CTE cemented tungsten carbide compositions of this invention as a function of temperature.

FIG. 4 graphically illustrates comparative CTEs for a conventional WC—Co composition v. WC-M composition (B) and WC-M composition (D) (of Examples 1 and 2, respectively) as a function of temperature, again within a temperature range of interest of between about 100° C. to 700° C. Here, however, each composition comprises approximately 13 percent by weight binder. As illustrated, the conventional WC—Co composition has a CTE within the range of between 5 to 7 ppm/° C. within this temperature range. In contrast, WC-M composition (B) has a CTE that is less than 5 ppm/° C. under about 500° C., and that increases to about 5.5 at 700° C. WC-M composition (D) has a CTE that is less than 2 ppm/° C. at 100° C., and that increases to about 4.5 at 700° C.

All of the WC-M compositions of this invention display a CTE of less than or equal to 6 ppm/° C. within a temperature range of 100 to 700° C. Further, WC-M compositions (A through D) display CTE values that are less than that of conventional WC—Co at the same temperature and having the same metal binder content.

Both WC-M compositions (B) and (D) demonstrate a CTE value that is again less than conventional WC—Co within the defined temperature window, and that is closely matched to the CTE value for WC itself, thereby displaying improved properties of thermal shock resistance when compared to a conventional WC—Co composition.

WC-M compositions of this invention comprising the binder alloy (M) are believed to provide improved thermal shock resistance by more closely matching the thermal expansion characteristics of the binder and WC grains. Matching the thermal expansion characteristics minimizes or, eliminates altogether, the creation of thermal stresses formed at the interface between the WC grains and the binder, thereby reducing or preventing the creation of heat checking, that can occur during cyclic heating and cooling. The ability to control heat checking reduces the subsequent formation of thermal shock related cracks and crack propagation that can eventually result in catastrophic material and part failure.

Figure 5:
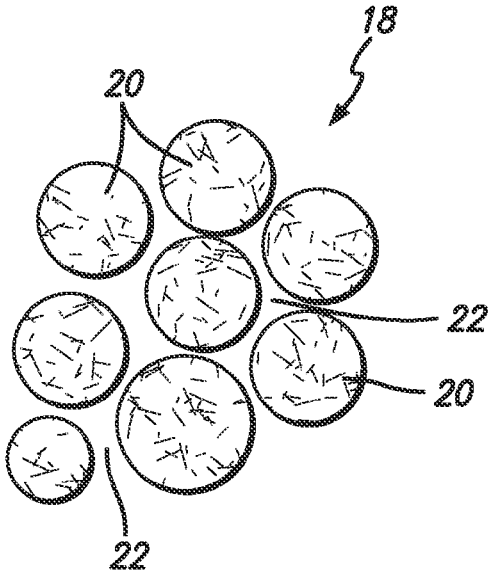
FIG. 5 is a schematic photomicrograph of a portion of a low CTE double-cemented tungsten carbide composition prepared according to principles of this invention.

In addition to the low CTE WC-M composition embodiments discussed above, low CTE binder alloys of this invention can be used to prepare low CTE double-cemented tungsten carbide compositions. As used herein, the term "double-cemented tungsten carbide compositions" refers to WC-M compositions 18 that have a microstructure as illustrated in FIG. 5, whereby a first cemented microstructure comprises a cemented carbide microstructure (e.g., cemented tungsten carbide, WC-M) as described above, while a second cemented microstructure comprises hard phase particles 20 formed from the first cemented microstructure (e.g., WC-M particles) surrounded by a continuous ductile binder phase 22 (formed from a ductile metal or metal alloy). Thus the term "double-cemented" or "dual-cemented" is used to refer to the fact that the so-formed composition includes a cemented microstructure that itself comprises a cemented microstructure as one of its components. Double-cemented tungsten carbide compositions, and methods for making the same, are disclosed in U.S. Pat. No. 5,880,382, which is incorporated herein by reference.

Broadly, double-cemented carbide compositions of this invention are made by mingling cemented hard phase particles (WC-M) with a second ductile phase binder (M) under conditions causing the cemented hard phase particles to be cemented by the second ductile phase binder. From a laminate perspective, a conventional laminate structure comprises a stack of sheets that has alternating materials along one geometric dimension. A fiber structure with a binder is considered to be a 2-D laminate. Double-cemented WC-M compositions of this invention can, therefore, be viewed as a 3-D laminate.

The microstructure of double-cemented WC-M compositions of this invention provides a structure that has a much higher fracture toughness than conventional cemented tungsten carbide (WC—Co) due to the enhanced crack blunting and deflective effects of the continuous binder phase 22 that surrounds each hard phase particle 20. The continuous binder phase increases the overall fracture toughness of the composition, by blunting or deflecting the front of a propagating crack if one occurs, without sacrificing either the overall hardness or wear resistance of the composition. The overall hardness of the composition is not sacrificed as the original ductile metal phase of the hard particles (e.g., the binder alloy phase of the cemented tungsten carbide hard particles) is merely redistributed between the hard particle phase and the new or second binder alloy. The overall wear resistance of the double-cemented composition is much higher than that of a conventional cemented tungsten carbide material that comprises the same amount of the total ductile binder phase material.

Double-cemented carbide compositions of this invention can be formed using different types of materials as the hard phase particles 20 as discussed above. The metallic cementing agent may be selected from the group of ductile materials including one or a combination of Co, Ni, Fe, W, Mo, Ti, Ta, V and Nb, which may be alloyed with each other or with C, B, Cr or Mn. Preferred cermets useful for forming the hard phase particles 20 include cemented tungsten carbide (WC) with a binder alloy (M) as described above as the binder phase.

The hard phase particles 20 useful for forming double carbide compositions of this invention include conventional cements, such as cemented tungsten carbide, having the following compositional range: carbide component in the range of from about 70 to 95 percent by weight, and binder alloy in the range of from about 5 to 30 percent by weight.

The hard phase particles 20 can also be formed from spherical cast carbide. Spherical cast carbide may be fabricated using the spinning disk rapid solidification process described in U.S. Pat. No. 4,723,996 and U.S. Pat. No. 5,089,182. Spherical cast carbide is a eutectic of WC and $W_2C$. If desired, the hard phase particles 20 can be formed from mixtures of cemented tungsten carbide and spherical cast carbide, or combinations of other hard phase particles described above.

In an example embodiment, the hard phase particles 20 are formed from the cemented tungsten carbide composition (WC-M) discussed above and illustrated in FIG. 1, wherein each particle comprises tungsten carbide grains bonded by a low CTE binder alloy. The WC-M particles can be made by conventional mixing, pressing, and sintering to form a WC-M body. Such a body can then be crushed and screened to obtain a desired particle size for use in this invention. Alternatively, the particles can be made directly by forming agglomerates of tungsten carbide and binder alloy of appropriate size which are then sintered to near net size. This enables one to determine the shape as well as the size of the particles.

The hard particles may be spherical, angular, or formed with a high aspect ratio. When the aspect ratio of the hard particles becomes much larger than two or three in one dimension, it can be characterized as a fiber. When two dimensions of the hard particles become much larger than the third dimension, the final composition can be characterized as a lamellar structure. It is recommended that the hard particles have an aspect ratio less than about ten because particles having an aspect ratio larger than ten approach what can be considered to be a fiber. A fiber composition having an aligned orientation is normally anisotropic. A key feature of the composition structure of this invention embodiment is that it is isotropic. Crushed WC-M particles are randomized in shape and have an average aspect ratio not much larger than one.

The relative size and volume fraction of the hard phase particles 20 and the ductile binder phase 22 surrounding the hard phase particles determine the combined mechanical and tribological behavior of the final compositions. Double-cemented carbide compositions of this invention may comprise in the range of from about 30 to 95 percent by volume of the hard phase particles 20 based on the total volume of the composition. The volume fraction of that hard phase particles is one of the most important factors affecting the mechanical properties of the final composition. It is desired that double-cemented carbide compositions be prepared using greater than about 30 percent by volume hard phase particles because using less than this amount can produce a final composition having an overall Modulus, and properties of strength and wear resistance that are too low for demanding applications such as rock bit inserts. It is desired that double-cemented carbide compositions of this invention be prepared using less than 95 percent by volume hard phase particles because using more than this amount can produce a final composition having a low fracture toughness similar to that of conventional cemented tungsten carbide.

The exact amount of the hard phase particles 20 that are used will vary depending on the desired mechanical properties for a particular application. For example, when the double-cemented carbide composition is used in a rock bit cutting structure, it is preferred that the hard phase particles be in the range of from about 60 to 80 percent by volume of the total volume of the composition.

The ductile binder phase 22 of double-cemented carbide compositions of this invention is selected from the group of materials comprising one or more ductile metal, ductile metal alloy, refractory metals, additives, and mixtures thereof. In a first embodiment double-cemented carbide composition, the ductile binder phase 22 that surrounds the hard phase particles 20 is low CTE binder alloy as discussed above. The use of such binder alloy having a low CTE is desired because it is both thermally compatible with the hard phase particles, thereby improving thermal fatigue crack resistance, and because it is more ductile than most commercial grade steels. Thus the binder alloy used to form the ductile binder phase 22 can be selected from those materials already disclosed above.

Double-cemented carbide compositions of this invention can be prepared by a number of different methods, e.g., by rapid omnidirectional compaction (ROC) process, hot pressing, infiltration, solid state or liquid, phase sintering, hot isostatic pressing (HIP), pneumatic isostatic forging, and combinations thereof as discussed in U.S. Pat. No. 5,880,382.

Third embodiment low CTE tungsten carbide compositions of this invention comprise an oriented microstructure having arrangements of hard phase materials, e.g., cermet materials, PCD, PCBN and the like, and relatively softer binder phase materials, e.g., metals, metal alloys, and in some instances cermet materials. Low CTE constructions with oriented microstructures of this invention are formed using the low CTE binder alloys described above, and generally comprise a continuous binder phase that is disposed around the harder phase of the composition to maximize the ductile effect of the binder phase.

Figure 6:
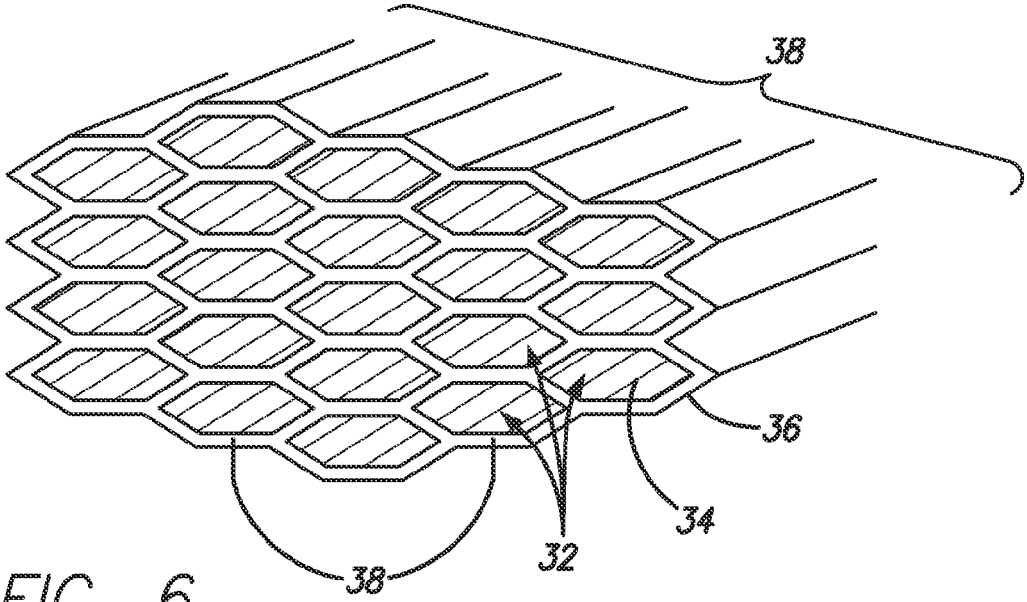
FIG. 6 is a schematic photomicrograph of a portion of a low CTE tungsten carbide composition of this invention having an oriented microstructure prepared according to principles of this invention.

FIG. 6 illustrates a third embodiment low CTE composition 30 comprising a plurality of bundled together cylindrical cased or coated fibers 32. Each fiber 32 comprises a core 34 formed from the hard phase material. Each core 34 is surrounded by a shell or casing 36 formed from the binder phase material. The shell or casing can be applied to each respective core by the method described in U.S. Pat. No. 4,772,524, which is incorporated herein by reference, or by other well known spray or coating processes. Additionally, "Flaw Tolerant, Fracture Resistant, Non-Brittle Materials Produced Via Conventional Powder Processing," (Materials Technology, Volume 10 1995, pp. 131-149), which is also incorporated herein by reference, describes an extrusion method for producing such coated fibers 32.

The plurality of coated fibers 32 are oriented parallel to a common axis and are bundled together and extruded into a rod 38, which comprises a cellular composition made up of binder phase material with hard phase material cores. Typically, before extrusion, the loose fibers 32 in the bundles are round in transverse cross section. After extrusion, the fibers 32 are squashed together and have a generally hexagonal cross section. The fibers may be deformed into other shapes locally where the fibers are not parallel to each other in the bundle or are not aligned to yield the regular hexagonal pattern illustrated. The fibers 32 are bonded together by heating to form an integral mass.

In an example third embodiment, the low CTE composition construction is produced from a plurality of coated fibers 32 having a core 34 of tungsten carbide and low CTE binder alloy powder (as the hard phase material) surrounded by a shell 36 of binder metal or binder alloy (as the ductile phase). The fibers are fabricated from a mixture of powdered WC-M, powdered binder metal or binder alloy (M), and thermoplastic binder such as wax by the extrusion process identified above. The binder metal or binder alloy may be as much as 50 percent by volume of the total mixture. A plurality of these binder metal or binder alloy cased WC-M fibers 18 are bundled together and extruded to form a fibrous WC-M construction. The extruded rod 38 can be cut to a desired geometry of the finished part, for example a cylinder with an approximately conical end for forming an insert for a rock bit, or sliced to form a cutting surface for placement onto a cutting substrate.

The low CTE construction is then dewaxed by heating in a vacuum or protective atmosphere to remove the thermoplastic binder. Upon heating to elevated temperature near the melting point of the binder metal or binder alloy, a solid, essentially void-free integral composition is formed. The regions defined by the fibers 32 have a WC—W core thickness in the range of from about 30 to 300 micrometers, surrounded by a shell of binder metal or binder alloy having a thickness in the range of from about 3 to 30 micrometers.

Although use of a tungsten carbide has been described above as example respective hard phase materials in each of the first, second and third composition embodiments, it is to be understood that compositions and constructions of this invention having low CTE binder alloys may be formed from many other different materials that are discussed in detail below. For example, instead of tungsten carbide, the hard phase material can be formed from PCD or PCBN according to the process described in U.S. Pat. Nos. 4,604,106; 4,694,918; 5,441,817; and 5,271,749 that are each incorporated herein by reference, starting with diamond or cBN powder and wax.

Second and third embodiment low CTE double-cemented and oriented cemented tungsten carbide compositions of this invention may be better understood and appreciated with reference to the following examples.

Example No. 3

Low CTE WC-M Double-Cemented Composition

Spherical WC-M sintered pellets, formed according to Example No. 1, having an average particle size of approximately 40 to 50 micrometers were wet milled together with the binder alloy described in Example No. 1, and approximately two percent by weight paraffin wax was added thereto. Approximately 36 percent by volume (i.e., less than 25 percent by weight) of the binder alloy was used. After milling, the powder was dried and it was pressed into green inserts on a uni-axial press to a specific dimension. The green insert was then presintered in a vacuum at approximately 950° C. for 30 minutes. The pre-sintered insert was then subject to a rapid omnidirectional compaction process at approximately 1,100° C. with 120 ksi pressure.

Example No. 4

Low CTE WC-M Composition Having Oriented Microstructure

A fiber composition construction included a hard phase material core formed from the WC-M composition described above in Example No. 1, that was made from WC powder and the binder alloy material of Example No. 1, having an average grain size in the range of from about one to six micrometers. The binder phase fiber shell was formed from the same binder alloy that was used to form the core, but alternatively could have been formed from any of the above-identified metals or metal alloys. Each fiber had a diameter in the range of from 30 to 300 micrometers after consolidation.

Low CTE WC-M compositions of this invention can be used in a number of different applications, such as tools for mining and construction applications, where mechanical properties of improved thermal shock resistance, high fracture toughness, wear resistance, and hardness are highly desired. WC-M compositions of this invention can be used to form wear and cutting components in such tools as roller cone bits, percussion or hammer bits, drag bits, and a number of different cutting and machine tools. For example, referring to FIG. 7, WC-M compositions of this invention can be used to form a mining or drill bit insert 40. Referring to FIG. 8, such an insert 40 can be used with a roller cone drill bit 42 comprising a body 44 having three legs 46, and a cutter cone 48 mounted on a lower end of each leg. Each roller cone bit insert 40 can be fabricated according to one of the methods described above. The inserts 40 are provided in the surfaces of the cutter cone 48 for bearing on a rock formation being drilled.

Although, limited embodiments of Low CTE WC-M compositions and constructions comprising low CTE binder alloys of this invention have been described and illustrated herein, many modifications and variations will be apparent to those skilled in the art. For example, although such low CTE WC-M compositions and constructions embodiments have been described and illustrated for use with rock bits, it is to be understood that compositions and constructions of this invention are intended to be used with other types of mining and construction tools, such as mining bits, hammer bits, diamond bits or the like. Accordingly, it is to be understood that within the scope of the appended claims, compositions of this invention may be embodied other than as specifically described herein.

What is claimed is:

1. A cutting element for engaging earthen formations having a wear surface formed from a low coefficient of thermal expansion composition consisting of:

a hard phase material selected from the group consisting of polycrystalline diamond and polycrystalline cubic boron nitride; and a ductile phase low coefficient of thermal expansion material formed from an alloy consisting of Co, Ni, Fe, C and Mn, wherein the hard phase material is bonded to one another by the ductile phase material to form the low coefficient of thermal expansion composition, and wherein the alloy has a coefficient of thermal expansion less than about 10 ppm/° C. within a temperature range of from 100 to 700° C.

2. The cutting element as recited in claim 1 wherein the alloy comprises in the range of from about 10 to 30 percent by weight Co based on the total weight of the alloy.

3. The cutting element as recited in claim 1 wherein the alloy has a coefficient of thermal expansion less than about 6 ppm/° C. within a temperature range of from 100 to 700° C.

4. The cutting element as recited in claim 1 wherein the alloy comprises in the range of from about 10 to 40 percent by weight Ni based on the total weight of the alloy.

5. The cutting element as recited in claim 1 wherein the ductile phase is in the form of a continuous phase and the hard phase is in the form of particles disposed within the ductile phase.

6. A bit for drilling earthen formations comprising a number of the cutting elements as recited in claim 1 attached thereto.

7. The cutting element as recited in claim 1 wherein the low coefficient of thermal expansion material is a continuous phase, and wherein the hard material is disposed therein.

8. The cutting element as recited in claim 1 wherein the combined hard material and alloy have engineered properties of fracture toughness, thermal shock resistance, and wear resistance.

9. The cutting element as recited in claim 1 wherein the hard material is polycrystalline diamond.

10. A bit for drilling earthen formations comprising:

a body; and a number of cutting elements operatively attached to the body, the cutting elements each comprising:

a hard material selected from the group consisting of polycrystalline diamond and polycrystalline cubic boron nitride; and a low coefficient of thermal expansion material attached to the hard material and formed from an alloy consisting of Co, Ni, Fe, C and Mn;

wherein the hard material and the alloy are disposed along an outside surface of the cutting element exposed to the earthen formation during drilling, and wherein the alloy has a coefficient of thermal expansion less than about 10 ppm/° C. within a temperature range of from 100 to 700° C.

11. The bit as recited in claim 10 wherein the alloy is in the form of a continuous phase and the hard material is disposed therein.

12. The bit as recited in claim 10 comprising a number of legs extending from the body, a cone rotatably disposed on a respective leg, and wherein the cutting elements are disposed on the cones.

13. The bit as recited in claim 10 wherein the hard material is polycrystalline diamond.

* * * * *